US008873787B2

(12) United States Patent
Bergere et al.

(10) Patent No.: US 8,873,787 B2
(45) Date of Patent: Oct. 28, 2014

(54) TWO-WAY AUDIO SPEAKER ARRANGEMENT

(75) Inventors: Julien Laurent Bergere, Brussels (BE); Benoit Burette, Etterbeek (BE)

(73) Assignee: Konindlijke Philips N.V. (NL)

( * ) Notice: Subject to any disclaimer, the term of this patent is extended or adjusted under 35 U.S.C. 154(b) by 496 days.

(21) Appl. No.: 13/125,138

(22) PCT Filed: Oct. 26, 2009

(86) PCT No.: PCT/IB2009/054712

§ 371 (c)(1),
(2), (4) Date: Apr. 20, 2011

(87) PCT Pub. No.: WO2010/049867

PCT Pub. Date: May 6, 2010

(65) Prior Publication Data

US 2011/0194720 A1 Aug. 11, 2011

(30) Foreign Application Priority Data

Oct. 28, 2008 (EP) ..... 08167700

(51) Int. Cl.
*H04R 9/06* (2006.01)
*H04R 1/24* (2006.01)
*H04R 1/26* (2006.01)

(52) U.S. Cl.
CPC .. *H04R 1/24* (2013.01); *H04R 1/26* (2013.01); *H04R 2205/024* (2013.01)
USPC ..... 381/335; 381/387; 381/99; 181/199

(58) Field of Classification Search
None
See application file for complete search history.

(56) References Cited

U.S. PATENT DOCUMENTS

| | | | | |
|---|---|---|---|---|
| 4,357,490 | A | 11/1982 | Dickey | |
| 4,365,114 | A * | 12/1982 | Soma | 381/182 |
| 2003/0179899 | A1 | 9/2003 | Welker et al. | |
| 2005/0286730 | A1 | 12/2005 | Pazandeh | |

FOREIGN PATENT DOCUMENTS

| | | | |
|---|---|---|---|
| JP | 2007028563 | A | 2/2007 |
| WO | 2006097857 | A1 | 9/2006 |

OTHER PUBLICATIONS

"Speaker Box Enclosure Designer / Calculator." DIY Audio and Video. Oct. 6, 2008. Web. <http://www.diyaudioandvideo.com/Calculator/Box/>.*

"Aurasound NSW2-326-8A-120 2" Full Range with Solder Pads. Madisound. Web. <http://www.madisoundspeakerstore.com/approx-2-fullrange/aurasound-nsw2-326-8a-120-2-full-range-with-solder-pds/>.*

Linkwitz Labs: "Pluto"; Website for Loudspeaker, Apr. 8, 2008, 21 Page Document, Retrieved at http://web.archive.org/web/20080418072747/www.linkwitzlab.com/Pluto/intro.htm>; retrieved on Jan. 20, 2010.

* cited by examiner

*Primary Examiner* — Joseph Saunders, Jr.
*Assistant Examiner* — James Mooney
(74) *Attorney, Agent, or Firm* — Jones Day

(57) ABSTRACT

A speaker arrangement comprises a first sound transducer (101) for reproducing sound in a lower frequency range and having a first on-axis direction and a first center point. The arrangement further comprises a second sound transducer (103) for reproducing sound in a higher frequency range, the second sound transducer (103) being mounted in front of the first sound transducer and having a second on-axis direction and a second center point. The transducers are positioned such that an angle between the first on-axis direction and the second on-axis direction is between 45° and 135°, and such that the distance between the first center point and the second center point is not higher than a cross-over wavelength corresponding to the cross-over frequency. The cross-over frequency between the lower frequency range and the higher frequency range is selected to be within the interval from 1.5 kHz to 3 kHz. An improved point source approximation may be achieved.

14 Claims, 5 Drawing Sheets

TWO-WAY AUDIO SPEAKER ARRANGEMENT

FIELD OF THE INVENTION

The invention relates to a loudspeaker arrangement and in particular, but not exclusively, to loudspeakers for approximating point source audio reproduction.

BACKGROUND OF THE INVENTION

For many audio applications, the ideal sound radiator may be characterized as a dimensionless full bandwidth omnidirectional pulsating sphere also referred to as a 'point source'. However, it is in practice impossible to provide such sound radiation characteristics and attempts to approach such an ideal sound generation has proved difficult and challenging as the requirements tend to be conflicting. For example, it is difficult for a very small speaker (i.e. approaching a dimensionless speaker) to move large amounts of air which is required for reproduction of bass frequencies at significant sound levels.

Traditional loudspeaker boxes typically contain two or more transducers that are aligned vertically and which partly share the reproduction of the same frequency range around the cross-over region. This tends to result in highly directional speakers which exhibit strong interference patterns in the vertical plane.

An example of a loudspeaker design is described in Patent Cooperation Treaty patent publication WO2006/097857. The disclosed loudspeaker design uses a low frequency loudspeaker combined with a high frequency loudspeaker which is mounted with a high distance to the low frequency speaker. Specifically, the two loudspeakers must be arranged with a distance of at least twice the wavelength of the cross-over frequency between the loudspeakers.

The system of WO2006/097857 has a number of interesting characteristics. For example, the arrangement tends to have low directivity at frequencies that are reproduced independently by the low frequency loudspeaker and the high frequency loudspeaker. Also, the interference between the loudspeakers tends to be perceived at a low level. The system tends to provide a reproduction of a sound stage that is very wide and deep and in which the speaker boxes are hardly perceived as being present.

Thus, the system of WO2006/097857 tends to provide a very immersive listening experience with the speakers seeming to blend in the soundstage. However, a disadvantage of the design is that it results in large speakers that are typically only suitable for use as large floor standing speakers.

Another example of a speaker design is the use of co-axial speaker arrangements wherein a high frequency transducer is placed in front of, or in the middle of, a low frequency transducer. The transducers are typically arranged to point directly towards the desired listening position with a coincidence of the perceived acoustic centres of both transducers. However, such speakers tend to be affected by reflection of the high frequency wave on the low frequency transducer surface resulting in a high directional directivity pattern and are therefore unsuitable for applications seeking to generate a point source audio radiation.

A modified co-axial speaker arrangement is provided in United States Patent application publication US 2003/0179899A1 which discloses a coaxial arrangement of a high frequency tweeter and a wide bandwidth loudspeaker. The coaxial arrangement is arranged in a partially upfiring configuration and reflectors are provided that reflect the upwards angled sound in a horizontal direction thereby providing a reduced directivity. However, although the speaker design may provide suitable characteristics in many embodiments, it tends to have some associated disadvantages. For example, the design is complex and sensitive to variations in the specific dimensions. For example, the reflectors must be carefully designed, manufactured and mounted to provide the desired effect. Accordingly, manufacturing tends to be suboptimal and/or costly. Also, the speaker arrangement tends to not provide optimal sound quality in some applications. Specifically, the reliance on reflected sound tends to result in a less focussed sound image being provided to the listener.

Another example of large floor standing speakers is the "Pluto" speaker designed by Linkwitz Labs.

The Pluto loudspeaker uses a frontfiring wide bandwidth sound transducer together with a low frequency woofer. The woofer assists the wide bandwidth sound transducer at low frequencies. The cut-off frequency between the wide bandwidth sound transducer and the low frequency woofer is at 1 kHz. In the design, the wide bandwidth sound transducer is implemented by a relatively large loudspeaker supported by a high acoustic load provided by a relatively large tube in which the wide bandwidth sound transducer is mounted. Indeed, in order to provide the desired audio characteristics, the speaker design requires a relatively large frontfiring sound transducer which is coupled with a substantial acoustic load thus requiring the frontfiring sound transducer to be mounted in a relatively large enclosure. In the design, the low frequency woofer is arranged in an upfiring configuration.

The Pluto loudspeaker may provide suitable performance for many audio applications but the reproduced sound quality tends to be suboptimal and a relatively high directivity results from the design. Notably, some reflections and diffraction from the woofer sound wave will occur onto the top part, which has non negligible dimensions compared to the wavelength around crossover frequency. The use of a large drive unit for the high-frequency also results in higher directivity. Also, the design is a large and floor standing loudspeaker which is unsuitable for many applications.

Hence, an improved speaker arrangement would be advantageous and in particular a speaker arrangement allowing reduced speaker size, reduced cost, facilitated manufacturing, increased design flexibility, improved audio quality, facilitated deployment, increased point source approximation and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided a speaker arrangement comprising: a first sound transducer for reproducing sound in a lower frequency range and having a first on-axis direction and a first centre point; and a second sound transducer for reproducing sound in a higher frequency range, the second sound transducer being mounted in front of the first transducer and having a second on-axis direction and a second centre point; wherein an angle between the first on-axis direction and the second on-axis direction is between 45° and 135° and a cross-over frequency between the lower frequency range and the higher frequency range is within the interval from 1.5 kHz to 3 kHz and a distance between the first centre point and the second centre point is not higher than a cross-over wavelength corresponding to the cross-over frequency.

The invention may provide an improved speaker arrangement. A reduced size speaker arrangement may be achieved which for example may be suitable for bookshelf loudspeaker implementations. An improved sound quality may be achieved in many scenarios. In particular, increased point source characteristics may be achieved. An improved trade-off between directional and non-directional sound can be achieved resulting in a focused sound image being generated at the same time as a point source approximation is perceived. The design may allow very small mounting arrangement to be used for the second sound transducer and may in particular allow an improved visual impact to be achieved. The short distance between the two transducers, related to the wavelength of the crossover frequency, may specifically reduce comb-filtering effects.

The cross-over frequency may specifically be the frequency at which the first and second sound transducer produces the same sound pressure level at a distance of 1 meter of the second sound transducer when measured in anechoic conditions.

The centre point for a sound transducer may specifically be a point of symmetry, an acoustic centre for the sound transducer, a geometric centre point and/or a centre of gravity for the sound transducer. Specifically, the centre point may be a point of symmetry on a radiating surface for the transducer, such as the point of the radiating surface which is intersected by the on-axis direction.

The first sound transducer may specifically be a high efficiency tweeter. The speaker arrangement may further comprise a drive unit for providing a lower frequency drive signal to the first transducer and a higher frequency drive signal to the second transducer from an input audio signal.

The on-axis direction of a sound transducer may specifically be a symmetric radiation-axis. For example, a sound transducer may be rotationally invariant or symmetric around the on-axis direction. The on-axis direction may be the direction of highest sound output of the sound transducer. Thus, the on-axis direction may correspond to the direction in which the maximum sound energy is radiated. The on-axis direction may specifically be defined by an axis through a center of the sound transducer.

In accordance with an optional feature of the invention, the first sound transducer is arranged in an upfiring configuration with the first on-axis direction having an angle relative to vertical of less than 50° with the speaker arrangement in an operational configuration.

This may provide improved performance in many scenarios. In particular, it may provide an improved approximation to a point source while allowing practical positioning of the loudspeaker arrangement. The operational configuration may specifically correspond to the speaker arrangement standing on a horizontal surface, such as a floor or shelve.

Particularly advantageous operation may in many embodiments be found for an angle of less than 30°.

In accordance with an optional feature of the invention, the second transducer is arranged in a front firing configuration with the second on-axis direction having an angle relative to horizontal of less than 50° with the speaker arrangement in an operational configuration.

This may provide improved performance in many scenarios. In particular, it may provide an improved approximation to a point source while allowing practical positioning of the loudspeaker arrangement. The front firing configuration may in particular provide improved focus of the sound image. The operational configuration may specifically correspond to the speaker arrangement standing on a horizontal surface, such as a floor or a shelf.

Particularly advantageous operation may in many embodiments be found for an angle of less than 20°.

In accordance with an optional feature of the invention, a maximum dimension of an enclosure for the second sound transducer is less than a quarter of the cross-over wavelength.

This may provide improved performance in many embodiments and may in particular provide a speaker arrangement capable of providing high quality sound reproduction and providing an improved approximation to a point source sound radiation. In particular, the feature may reduce interference between the transducers thereby providing an improved sound image perception.

The enclosure may be a dedicated enclosure for the second sound transducer and may not comprise any other sound transducers.

In accordance with an optional feature of the invention, a volume of an enclosure for the second sound transducer is less than $4 \cdot d^3$ where d is a maximum dimension of a radiating surface of the second sound transducer.

This may provide improved performance in many embodiments and may in particular provide a speaker arrangement capable of providing high quality sound reproduction and providing an improved approximation to a point source sound radiation. In particular, the feature may reduce interference between the transducers thereby providing an improved sound image perception.

The enclosure may be a dedicated enclosure for the second sound transducer and may not comprise any other sound transducers. The maximum dimension may for example correspond to a diameter of a circular radiating surface.

In accordance with an optional feature of the invention, a volume of an enclosure for the second sound transducer is less than 150 $cm^3$.

In accordance with an optional feature of the invention, a volume of elements of a mounting arrangement for the second sound transducer within a space defined by a periphery of a radiating surface of the first sound transducer infinitely extended along the first on-axis direction is less than $6 \cdot d^3$ where d is a maximum dimension of a radiating surface of the second sound transducer.

This may provide improved performance in many embodiments and may in particular provide a speaker arrangement capable of providing high quality sound reproduction and providing an improved approximation to a point source sound radiation. In particular, the feature may reduce interference between the transducers thereby providing an improved sound image perception.

The mounting arrangement may include an enclosure for the second sound transducer as well as elements of the second sound transducer itself. The enclosure may be a dedicated enclosure for the second sound transducer and may not comprise any other sound transducers. The maximum dimension may for example correspond to a diameter of the circular radiating surface.

In some embodiments, the volume of elements of a mounting arrangement for the second sound transducer within a space defined by a periphery of a radiating surface of the first sound transducer infinitely extended along the first on-axis direction is less than $3 \cdot (0.5 \cdot d)^3$ where d is a maximum dimension of a radiating surface of the first sound transducer.

This may provide improved performance in many embodiments and may in particular provide a speaker arrangement capable of providing high quality sound reproduction and providing an improved approximation to a point source sound radiation. In particular, the feature may reduce interference between the transducers thereby providing an improved sound image perception.

The mounting arrangement may include an enclosure for the second sound transducer as well as elements of the second sound transducer itself. The enclosure may be a dedicated enclosure for the second sound transducer and may not comprise any other sound transducers. The maximum dimension may for example correspond to a diameter of the circular radiating surface.

In accordance with an optional feature of the invention, a volume of elements of a mounting arrangement for the second sound transducer within a space defined by a periphery of a radiating surface of the first sound transducer infinitely extended along the first on-axis direction is less than 200 $cm^3$.

In accordance with an optional feature of the invention, the speaker arrangement further comprises: a first enclosure comprising only the first sound transducer; a second enclosure comprising only the second sound transducer; and a mounting structure for positioning the first enclosure relative to the second enclosure.

This may provide facilitated implementation and/or improved audio performance. In particular, the first enclosure may comprise no other active sound transducer than the first sound transducer and the second enclosure may comprise no other active sound transducer than the second sound transducer.

The second enclosure may specifically be designed to not comprise any diffraction edges. Thus, a smooth e.g. spherical or droplet shaped enclosure may be used.

In accordance with an optional feature of the invention, a volume of the mounting structure within a space defined by a periphery of a radiating surface of the first sound transducer infinitely extended along the first on-axis direction is less than $0.5 \cdot d^3$ where d is a maximum dimension of a radiating surface of the second sound transducer.

This may provide improved performance in many embodiments and may in particular provide a speaker arrangement capable of providing high quality sound reproduction and providing an improved approximation to a point source sound radiation. In particular, the feature may reduce interference between the sound transducers thereby providing an improved sound image perception. The maximum dimension may for example correspond to a diameter of a circular radiating surface.

In accordance with an optional feature of the invention, a volume of elements of a mounting arrangement for the second sound transducer within a space defined by a periphery of a radiating surface of the first sound transducer infinitely extended along the first on-axis direction is less than 200 $cm^3$.

This may provide improved performance in many embodiments and may in particular provide a speaker arrangement capable of providing high quality sound reproduction and providing an improved approximation to a point source sound radiation. In particular, the feature may reduce interference between the transducers thereby providing an improved sound image perception.

The mounting arrangement may include an enclosure for the second sound transducer as well as elements of the second sound transducer itself. The enclosure may be a dedicated enclosure for the second sound transducer and may not comprise any other sound transducers. The maximum dimension may for example correspond to a diameter of a circular radiating surface.

In accordance with an optional feature of the invention, a volume of an enclosure for the second sound transducer is less than 21 liters.

The invention may provide improved performance in many embodiments and may in particular provide a speaker arrangement capable of providing high quality sound reproduction and providing an improved approximation to a point source sound radiation while maintaining a low physical size suitable e.g. for bookshelf sized speakers.

In accordance with an optional feature of the invention, an area of a radiating surface of the first sound transducer covered by a projection along the first on-axis direction of elements of a mounting arrangement for the second transducer is less than 50% of a total area of the radiating surface.

This may provide improved performance in many embodiments and may in particular provide a speaker arrangement capable of providing high quality sound reproduction and may provide an improved approximation to a point source sound radiation. In particular, the feature may reduce interference between the transducers thereby providing an improved sound image perception.

In accordance with an optional feature of the invention, the second centre point lies within a space defined by a periphery of a radiating surface of the first sound transducer infinitely extended along the first on-axis direction.

This may provide improved performance in many embodiments and may in particular provide a speaker arrangement capable of providing high quality sound reproduction and of providing an improved approximation to a point source sound radiation.

In accordance with an optional feature of the invention, a distance from a closest point of the second sound transducer to the first on-axis direction is less than a quarter of a maximum dimension of a radiating surface of the first sound transducer.

This may provide improved performance in many embodiments and may in particular provide a speaker arrangement capable of providing high quality sound reproduction and of providing an improved approximation to a point source sound radiation.

In accordance with an optional feature of the invention, the distance between the first centre point and the second centre point is higher than one tenth of the cross-over wavelength.

This may provide improved performance in many embodiments and may in particular reduce interference between the sound transducers. In particular, reflections of the audio signal from the second sound transducer of the first sound transducer may be reduced.

According to an aspect of the invention there is provided a method of providing a speaker arrangement of claim 1 the method comprising: providing a first sound transducer for reproducing sound in a lower frequency range and having a first on-axis direction and a first centre point; and providing a second sound transducer for reproducing sound in a higher frequency range, the second sound transducer being mounted in front of the first transducer and having a second on-axis direction and a second centre point; wherein an angle between the first on-axis direction and the second on-axis direction is between 45° and 135° and a cross-over frequency between the lower frequency range and the higher frequency range is within the interval from 1.5 kHz to 3 kHz and a distance between the first centre point and the second centre point is not higher than a cross-over wavelength corresponding to the cross-over frequency.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

Figure 1:
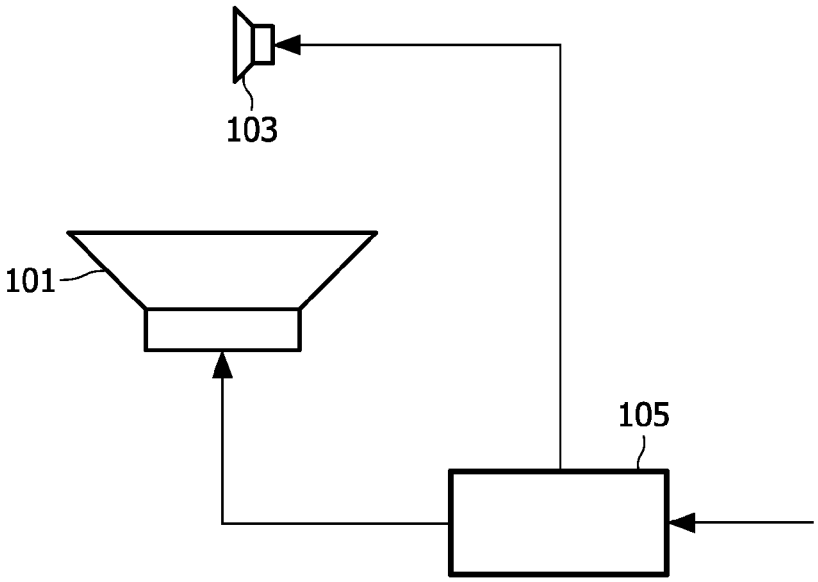
FIG. 1 is an illustration of an example of a speaker arrangement in accordance with some embodiments of the invention.

FIG. 1 illustrates an example of a speaker arrangement in accordance with some embodiments of the invention. The speaker arrangement comprises a low frequency (sound) transducer 101 which in the specific example is a low frequency loudspeaker. The speaker arrangement further comprises a high frequency (sound) transducer 103 which in the specific example is a high frequency and high efficiency tweeter. The two sound transducers 101, 103 thus provide a two-way speaker arrangement with the low frequency transducer 101 predominantly generating sound in a lower frequency range and the high frequency transducer 103 predominantly generating sound in a higher frequency range The speaker arrangement has a cross-over frequency which may be defined as the frequency at which the two transducers 101, 103 contribute equally to the generated sound. Specifically, the cross-over frequency may defined as the frequency at which the low frequency transducer 101 and the high frequency transducer 103 produces the same sound pressure level at a distance of 1 meter of the high frequency transducer 103 when measured in anechoic conditions.

The speaker arrangement is driven by a drive circuit 105 which receives an audio signal for reproduction and generates individual drive signals for the low frequency transducer 101 and the high frequency transducer 103. The drive circuit 105 may specifically comprise a cross-over filter which performs a low pass filtering of the input signal to generate the drive signal for the low frequency transducer 101 and a high pass filtering of the input signal to generate the drive signal for the high frequency transducer 103.

It will be appreciated that the cross-over frequency may be determined to include the characteristics of the drive circuit 105. Thus, the drive circuit 105 may in some embodiments or scenarios be considered part of the speaker arrangement and the impact of the cross-over filter may be included when determining a cross-over frequency for the system.

It will be appreciated that although the following description will focus on embodiments wherein the speaker system is a two-way system, other embodiments may use a three-way or higher system. For example, the frequency range covered by the low frequency transducer 101 of FIG. 1 may be covered by a plurality of speakers in other embodiments, such as for example a midrange speaker and a subwoofer.

Each of the transducers has an on-axis direction and a centre point.

The on-axis direction of a sound transducer may specifically be a symmetric radiation-axis. For example, a sound transducer may be rotationally invariant or symmetric around the on-axis direction. The on-axis direction may be the direction of highest sound output of the sound transducer. Thus, the on-axis direction may correspond to the direction in which the maximum sound energy is radiated. The on-axis direction may specifically be defined by an axis through a center of the sound transducer.

The centre point may in some embodiments be defined as the acoustic center for the sound transducer (a point from which sound waves seem to originate). Alternatively, the centre point may be a geometric center point for the sound transducer. Specifically, the centre point may be the centre point of a radiating surface of the transducer. For example, for a symmetric radiating surface, the centre point may be the center point of symmetry for the radiating surface. E.g. for a circular radiating surface, the centre point is the center of the radiating surface. Thus, the centre point for a loudspeaker may be the middle point of the diaphragm of the loudspeaker (i.e. a center point on the diaphragm surface). In some scenarios, the center point may be considered to be the center of gravity of the transducer.

Specifically, the centre point may be the point where the on-axis direction intersects the radiating surface of a sound transducer.

Figure 2:
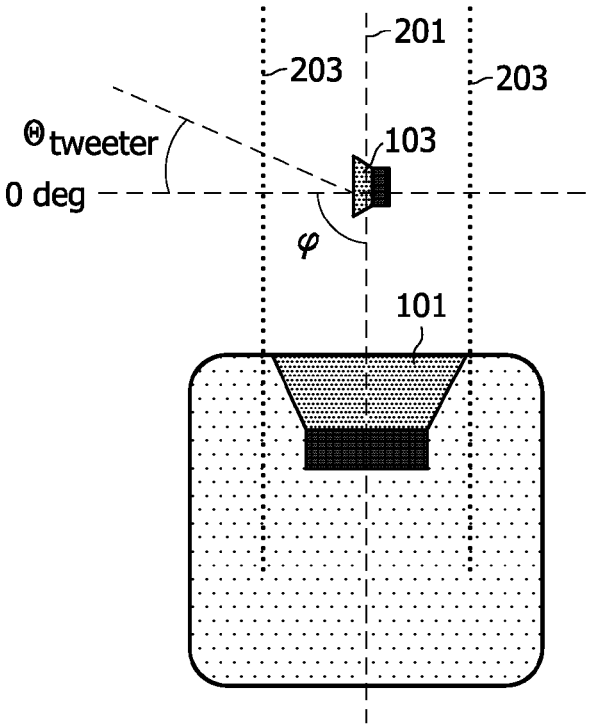
FIG. 2 is an illustration of an example of a speaker arrangement in accordance with some embodiments of the invention.

In the system, the low frequency transducer 101 and the nigh frequency transducer 103 are arranged such that their on-axis directions form an angle of between 45° and 135° (both values included). Specifically, as illustrated in FIG. 2, the low frequency transducer 101 and the high frequency transducer 103 may be mounted such that their on-axis direction may be at an angle, $\phi$, of substantially 90° relative to each other. In many scenarios best performance is achieved for an angle between 70° to 130° and in particular for a relative angle of 90 to 130 degrees (i.e. with the high frequency transducer 103 slightly up-firing).

In the specific example of FIG. 2, the low frequency transducer 101 is arranged in an upfiring configuration. Thus, when the speaker arrangement is in an operational configuration, e.g. the enclosure for the low frequency transducer 101 is placed on a substantially horizontal plane such as a floor or shelf, the on-axis direction of the low frequency transducer 101 is at an angle of substantially 90° relative to horizontal, i.e. it is substantially vertical.

Furthermore, the high frequency transducer 103 is arranged in a front firing configuration. Thus, when the speaker arrangement is in an operational configuration, e.g. the enclosure for the low frequency transducer 101 is placed on a substantially horizontal plane, such as a floor or shelf, the on-axis direction of the high frequency transducer 103 is at an angle of substantially 90° relative to vertical, i.e. it is substantially horizontal.

Thus, the speaker arrangement is such that the lower frequency range is radiated in an upwards direction and typically reaches the listener via various reflections and indirect paths. However, the higher frequency range is radiated directly towards the listening position and provides a less diffuse and more directional perception.

The cross-over between the lower and higher frequency ranges is from 1.5 kHz to 3 kHz (both values included). Thus, the direct radiation of sound from the frontfiring high frequency transducer 103 is limited to relatively high frequencies whereas the lower and midrange frequencies are radiated indirectly. This provides an improved audio perception and in particular results in an improved point source approximation. In particular, in comparison to a similar arrangement using a cross-over frequency of, say, 1 kHz or below, an improved point source approximation is achieved by radiating the mid range in an upfiring configuration. Furthermore, this is achieved without significant loss of directional perception as the high frequencies are radiated directly and provide more significant directional cues to the listener. Thus a focused sound image is still maintained.

The high frequency transducer 103 is located very close to the low frequency transducer 101. Specifically, the distance between the centre points of the two transducers 101, 103 is less than the wavelength of the cross-over frequency. Thus, a very compact arrangement is achieved which may e.g. be suitable for implementation in e.g. a bookshelf speaker size. This close proximity between the transducers 101, 103 is achieved by controlling and reducing interference and reflections between the transducers 101, 103.

The high frequency transducer 103 is located above the low frequency transducer 101. Thus, the high frequency transducer 103 is located in the direction of the main sound radiation of the low frequency transducer 101, i.e. on the side of the low frequency transducer 101 that has the highest sound radiation gain. Furthermore, the high frequency transducer 103 is located such that a projection of the high frequency transducer 103 along the on-axis direction and on to the low frequency transducer 101 will fall at lest partly within the radiating surface of the low frequency transducer 101.

Thus, the high frequency transducer 103 will at least partly be within the space of an imaginary tube defined by infinitely extending the periphery of the radiating surface of the low frequency transducer 101 in a direction which is parallel to the on-axis direction of the low frequency transducer 101. For a typical mid-range loudspeaker, the radiating surface will be the membrane/diaphragm which is moved to generate sound. For a circular membrane, an imaginary cylinder will be defined by the circumference of the membrane being extended along the on-axis direction, i.e. the infinitely long cylinder will have a central axis corresponding to the on-axis direction and a diameter corresponding to that of the membrane. FIG. 2 illustrates this example where an imaginary cylinder has the on-axis direction 201 as the central axis with the walls (shown in cross sections 203) being defined by the periphery of the radiating surface of the low frequency transducer 101.

The high frequency transducer 103 will then at least partly be located within this imaginary tube and will typically be fully within the imaginary tube. In many embodiments, an improved visual impact and audio quality will be achieved by locating the high frequency transducer 103 centrally with respect to the low frequency transducer 101. In the specific example, the centre point of the high frequency transducer 103 is located substantially on the on-axis direction of the low frequency transducer 101. In many embodiments, advantageous performance and visual impact is achieved by the distance from the high frequency transducer 103 to the on-axis direction of the low frequency transducer 101 being kept less than a quarter of the maximum dimension the radiating surface of the low frequency transducer 101. Specifically, the distance to the on-axis direction may be less than a quarter of the diameter of a sound generating membrane of the low frequency transducer 101.

Thus, the high frequency transducer 103 is located in the main beam direction of the low frequency transducer 101 and is located close to the low frequency transducer 101. Indeed, the transducers are arranged so close that the distance between the centre point of the low frequency transducer 101 and the centre point of the high frequency transducer 103 is less than (or equal to) the wavelength of the cross-over frequency.

The close proximity of the high frequency transducer 103 to the low frequency transducer 101 allows a compact loudspeaker arrangement to be generated. In particular, it allows bookshelf sized speakers to be produced which can provide high quality sound from speakers approaching point sources.

The positioning of the transducers 101, 103 is furthermore such that the distance between the centre points of the high frequency transducer 103 and the low frequency transducer 101 is above one tenth of the cross-over wavelength. This may improve sound quality and may in particular reduce the interference and reflections from one transducer to the other. In particular, it may reduce the reflections of the high frequency signals on the radiating surface of the low frequency transducer 101 thereby reducing the interference and cross coloration of the sound.

Figure 3:
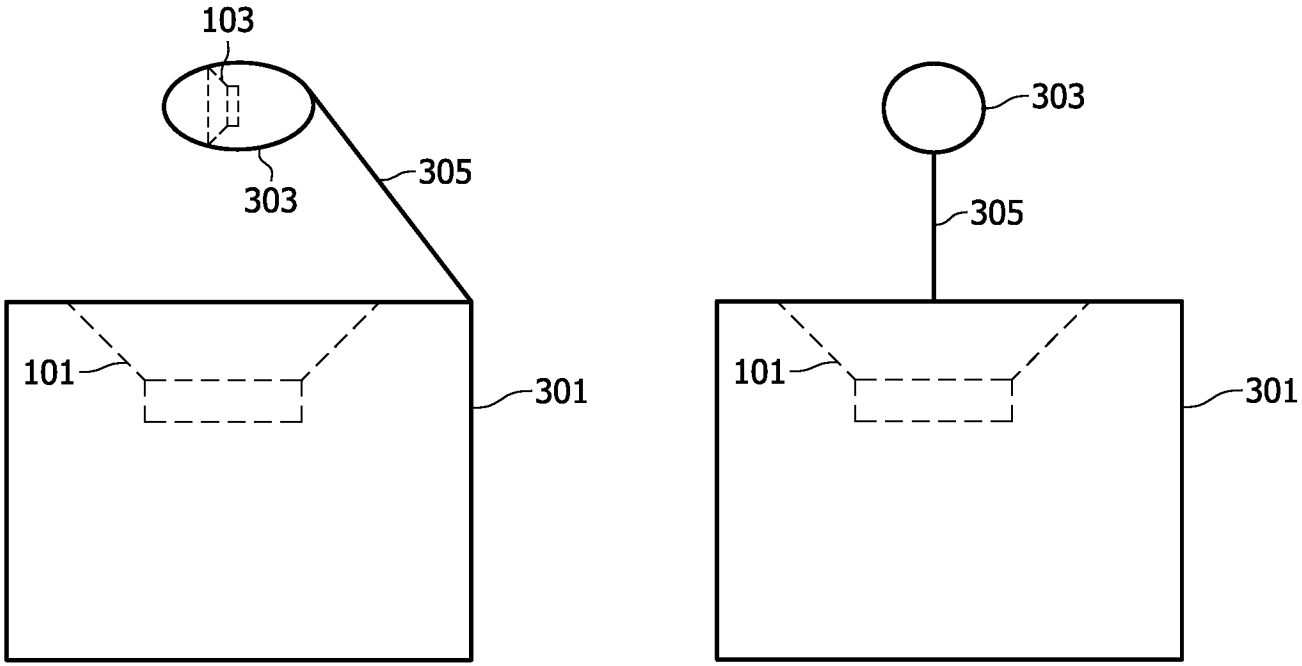
FIG. 3 is an illustration of an example of a speaker arrangement in accordance with some embodiments of the invention.

The low frequency transducer 101 and the high frequency transducer 103 are mounted in different enclosures. FIG. 3 illustrates an example of a possible speaker system comprising the described speaker arrangement. In the example, the low frequency transducer 101 is mounted in a first enclosure 301 which may for example be a closed acoustic enclosure or may e.g. comprise bass reflect part, passive sound transducers etc. It will also be appreciated that in some embodiments, the first enclosure may 301 comprise a plurality of sound transducers such as subwoofer loudspeakers etc. However, in the example of FIG. 3 the low frequency enclosure comprises no other (active) sound transducers than the low frequency transducer 101.

The volume of the first enclosure 301 may be kept relatively low and indeed a high quality sound reproduction may be achieved for volumes below 21 liters thereby allowing speaker systems to be designed for e.g. the bookshelf speaker market. In the specific example, the low frequency transducer 101 is a 15.5 cm diameter loudspeaker which provides a high quality audio reproduction for the lower and mid range.

Similarly, the high frequency transducer 103 is mounted in a second enclosure 303 positioned above the low frequency transducer 101. The second enclosure 303 comprises no other sound transducers than the high frequency transducer 103. In the specific example, the high frequency transducer 103 is a high efficiency tweeter which is mounted in an acoustic enclosure that has a rounded or smoothed shape thereby reducing or substantially eliminating diffraction effects.

The second enclosure 303 is fixed relative to the first enclosure 301 by a mounting structure 305 which in the specific example is single supporting element that is fixed to the first and second enclosure 301, 303 and has a shape such that the second enclosure 303 is held in the desired position relative to the first enclosure 301.

In order to maintain a low interference and obtain a high degree of point source approximation, the size of the second enclosure 303 is kept low. Indeed, the second enclosure 303 is dimensioned such that a maximum dimension of the second enclosure 303 enclosure is less than a quarter of the cross-over wavelength. Specifically, for a cross-over frequency of 1.5 KHz, any cross section of the second enclosure 303 will not have any internal length which is larger than around 6 cm and for a cross-over frequency of 3 kHz, any cross section of the second enclosure 303 will not have any internal length which is larger than around 3 cm.

In the specific example, the high frequency transducer 103 is a tweeter with a diameter of around 4 cm and a depth of around 2.5 cm. The tweeter is held in an enclosure which has a maximum diameter of around 5 cm and a length along the on-axis direction of around 4 cm.

The second enclosure 303 is kept to a volume which is low and which specifically is less than $4 \cdot d^3$ where d is a maximum dimension of the radiating surface of the high frequency transducer 103. The radiating surface may be considered to correspond to the acoustic 'piston' or moving parts which is typically smaller than the tweeter itself (and thus smaller than the housing 303.

In the example a tweeter is used which is 33.5 mm in diameter, and with a cover grille of 40 mm in diameter. For the specific example, the radiating surface is about 25 mm in diameter resulting in $4\cdot(2.5)^3=62.5\ cm^3$ (which is equivalent to a sphere of 49 mm in diameter). Thus, in the specific example the total volume of the second enclosure 303 is kept below 62.5 $cm^3$.

In most embodiments, particular advantageous performance can be achieved by the volume of the second enclosure being below 150 $cm^3$.

In order to reduce the acoustic impact of the mounting structure 305 is also kept to a low volume and cross section when viewed from the radiating surface of the low frequency transducer 101. In the specific example, the mounting structure 305 is an elongated element which supports the second enclosure 303. The mounting structure typically has a cross section dimension of less than a tenth of the length of the elongated element. Thus, a long and thin bar or rod may be used to hold the high frequency transducer 103 in place above the low frequency transducer 101.

The physical dimensions are kept low such that acoustic impact on the low frequency transducer 101 is reduced. This is achieved by keeping the visual coverage from the radiating surface of the low frequency transducer 101 of the second enclosure 303 and mounting structure low. Specifically, the system is designed such that when the mounting arrangement for the high frequency transducer 103 (including the second enclosure 303 and the mounting structure 305) is projected on the radiating surface of the low frequency transducer 101, the resulting area covered is less than 50% of the total area of the radiating surface. The projection is along the on-axis direction.

Also, the design is such that the part of the mounting arrangement which is within the imaginary tube defined by the periphery of the radiating surface of the low frequency transducer 101 is kept low. Specifically, the total volume of the elements of the mounting arrangement for the high frequency transducer 103 (including the high frequency transducer 103 itself) is less than $6\cdot d^3$ where d is a maximum dimension of the radiating surface of the high frequency transducer 103. For example, for the previously mentioned tweeter, the volume of the mounting arrangement within this imaginary tube is less than 94 $cm^3$.

In many embodiments, even smaller designs are used. In many embodiments, particularly advantageous performance can be achieved for a total volume of less than 200 $cm^3$ is used.

The volume of the part of the mounting arrangement for the high frequency transducer 103 which is within the imaginary tube is also kept low relative to the low frequency transducer 101. Specifically, the volume within the imaginary tube is kept below $3\cdot(0.5\cdot d)^3$ where d is a maximum dimension of a radiating surface of the first sound transducer.

The volume of the mounting structure 305 within the imaginary tube is specifically kept very low and is typically only designed to be sufficiently large to provide the desired physical strength. Typically, the total volume of the volume of the mounting structure is kept below $0.5\cdot d^3$ where d is a maximum dimension of the radiating surface of the high frequency transducer 103.

The high cross-over frequency results in the high frequency transducer 103 only having to support the high frequency range rather than having to support midrange or full range audio, the second enclosure 303 may be made small. As a consequence, the reflections by the second enclosure 303 of the sound from the low frequency transducer 101 may be substantially reduced which provides for an increased point source approximation and further allows the low frequency transducer 101 to not only provide subwoofer performance but rather to support the whole midrange. Thus, the design with an upfiring low and midrange sound transducer coupled with a frontfiring tweeter for the high range provides reduced reflections and cross transducer interference resulting in an improved sound quality and an improved approximation to a point source.

Furthermore, by using a very small high frequency transducer, the physical strength requirements for the support arrangement may be used thereby not only reducing reflections but also allowing an improved visual appearance. For example, a visual impression of a small rounded enclosure "floating" above the larger enclosure for the low frequency transducer 101 can be achieved.

It will be appreciated that the enclosures 301, 303 and the mounting structure 305 need not be separate elements but may e.g. be formed as an integral unit.

Figure 4:
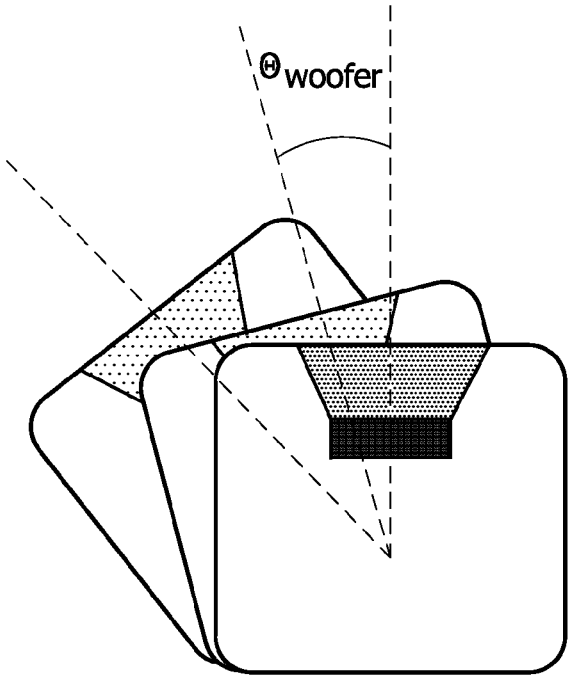
FIG. 4 is an illustration of an example of a speaker arrangement in accordance with some embodiments of the invention.
Figure 5:
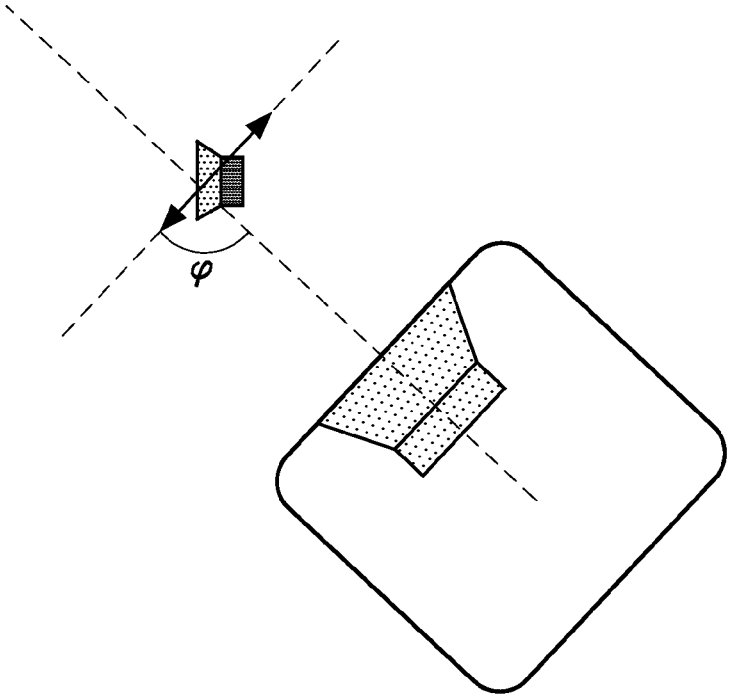
FIG. 5 is an illustration of an example of a speaker arrangement in accordance with some embodiments of the invention.

It will be appreciated that although the previous description focused on a speaker arrangement wherein the low frequency transducer 101 is exactly upfiring (i.e. the on-axis direction is vertical), the low frequency transducer 101 may in some embodiments be tilted relative to this angle. Specifically, as illustrated in FIGS. 4 and 5, the on-axis direction for the low frequency transducer 101 may be tilted when in the operational configuration/position. The tilting may allow a trade off in the sound balance between low-frequency sound and midrange-frequency sounds to be adjusted for the preferences of the specific embodiment. However, best performance tends to be achieved for the angle between the on-axis direction and vertical to be below 50°, and specifically to be less than 25°. In particular, in many embodiments particularly advantageous performance can be achieved for the angle between the on-axis direction and vertical being between 15° and 25° (both values included).

Similarly, the high frequency transducer 103 need not specifically be arranged with a horizontal on-axis direction. Rather, advantageous performance can be achieved with the angle between the on-axis direction and horizontal being below 50° and specifically to be less than 15°.

The described speaker arrangement provides a highly advantageous system with a number of advantages characteristics. In particular, the system provides an improved approximation to a point source sound radiation while allowing a compact implementation.

The upfiring configuration of the low frequency transducer 101 may provide a more omni-directional radiation in the horizontal plane. Furthermore, it provides a better averaging/canceling out of the path difference between the high frequency transducer 103 and each point of the low frequency transducer 101 thereby contributing to a reduced interference between these transducers.

The high frequency transducer's 103 position above the low frequency transducer 101 reduces reflection of the sound wave of the high frequency transducer 103 by the speaker enclosure for a listener placed in the horizontal plane. Thus, the positioning of the high frequency transducer may prevent reflections from the emitted sound waves onto the lower frequency transducer enclosure from reaching the main listening area.

The arrangement may allow the high frequency transducer 103 to be mounted in an enclosure which is optimized for the high frequency transducer 103.

The high frequency transducer 103 is front-firing thereby provide improved linearity in the frequency response at high frequencies (e.g. tweeters become very directive at high frequencies). This may provide a more focused sound image.

Figure 6:
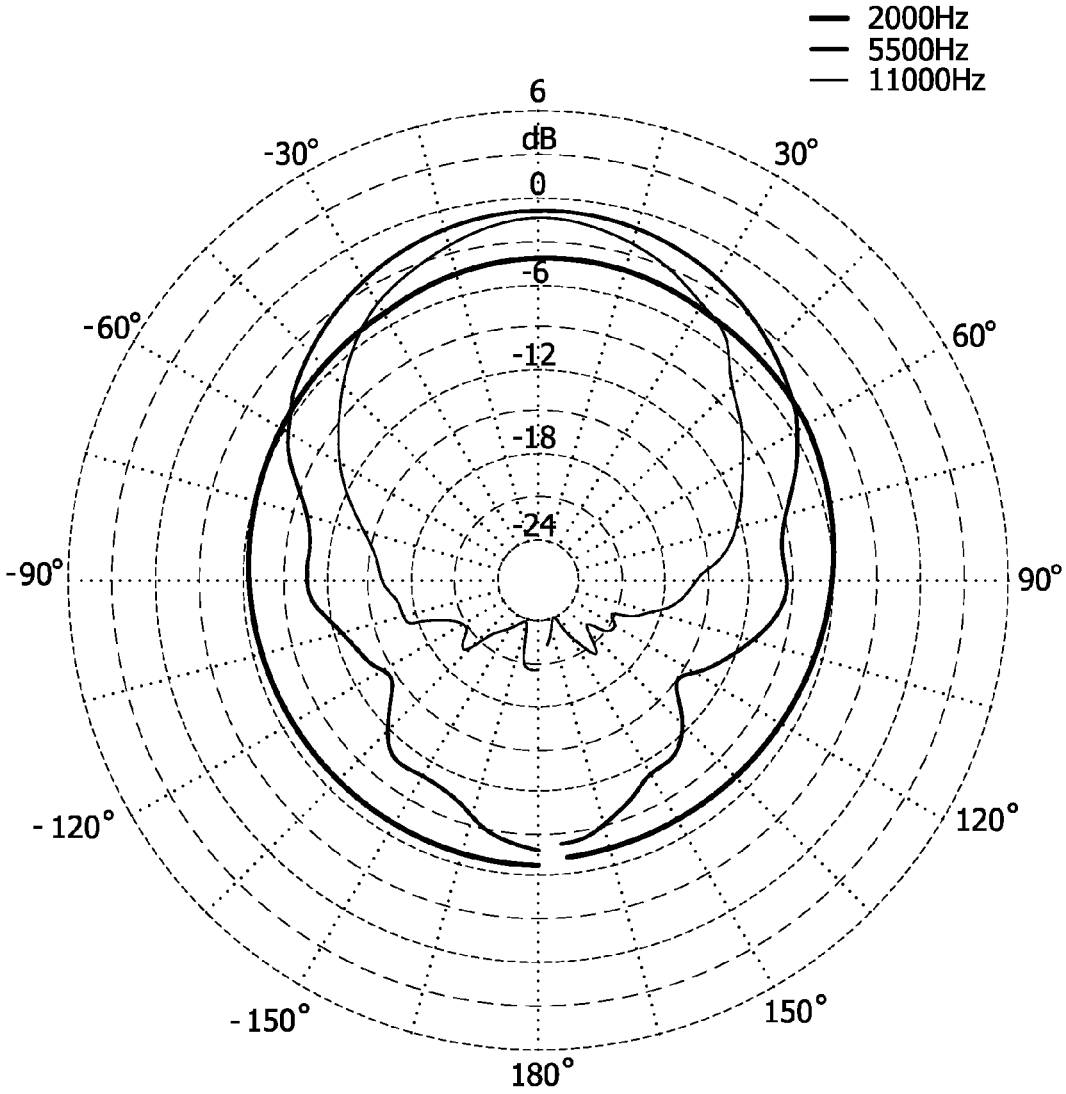
FIG. 6 illustrates an example of a measured polar pattern for a high frequency transducer of a speaker arrangement in accordance with some embodiments of the invention.
Figure 7:
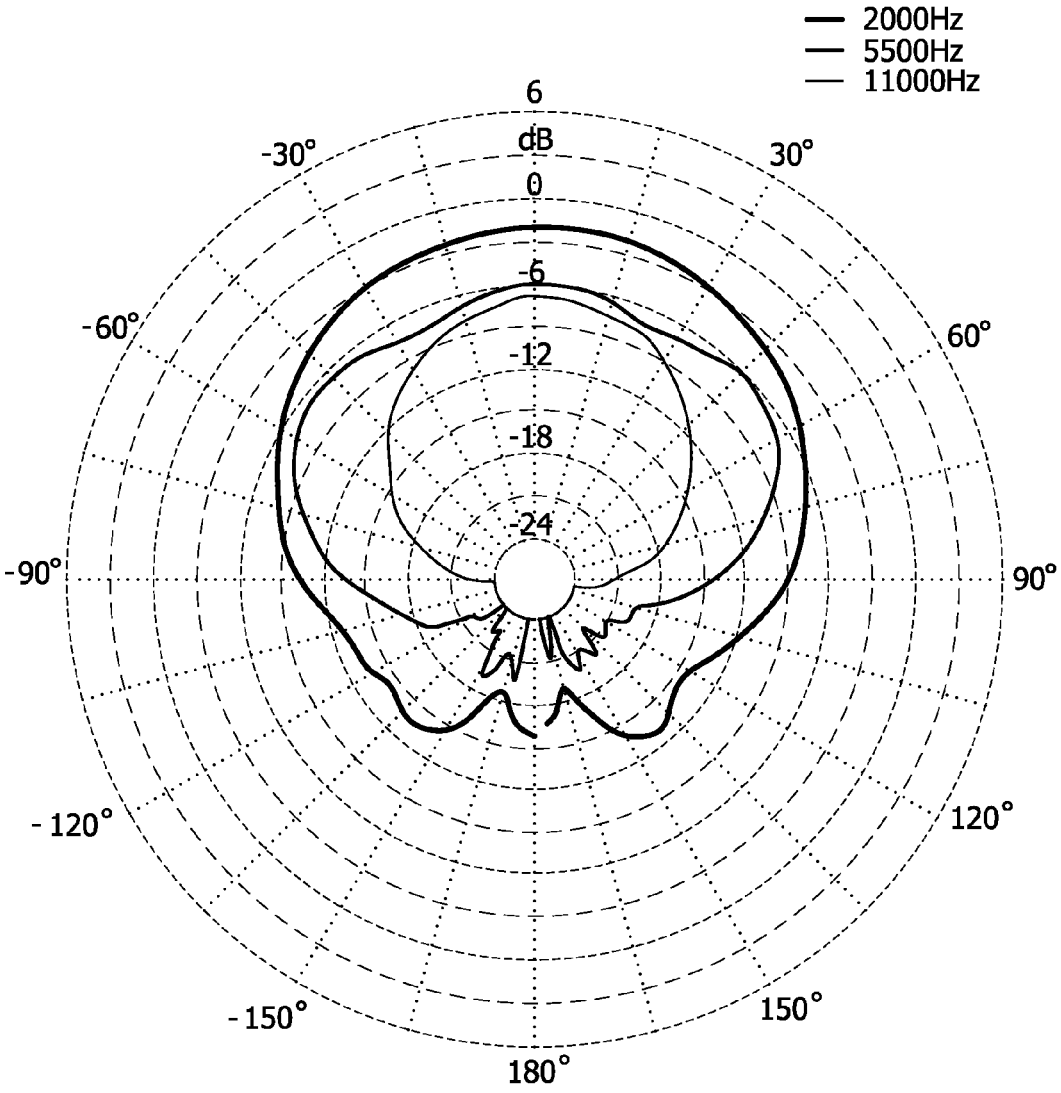
FIG. 7 illustrates an example of a measured polar pattern for a high frequency transducer mounted in a traditional bookshelf-size speaker baffle.

FIG. 6 illustrates an example of a measured polar pattern for a high frequency transducer 103 which is mounted in accordance with the described approach. FIG. 7 illustrates an example of a measured polar pattern for the same high frequency transducer 103 mounted on a traditional bookshelf-size speaker baffle. As can be seen, the described approach exhibits progressive beaming towards the front at high frequencies, where a baffled tweeter shows varying shapes of polar patterns as the frequency rises.

Furthermore, by limiting the high frequency transducer 103 to the high range from 1.5 kHz and above, a very small enclosure and mounting structure can be used thereby reducing reflections and allowing for a substantially improved visual impact. The small size of the enclosure bearing the high frequency transducer 103 ensures that there is minimal reflection from the sound waves of the lower frequency transducer 101 onto it.

The short distance between the two transducers, related to the wavelength of the crossover frequency, may furthermore result in reduced comb-filtering effects.

The invention can be implemented in any suitable form. The elements and components of an embodiment of the invention may be physically, functionally and logically implemented in any suitable way. Indeed the functionality may be implemented in a single unit, in a plurality of units or as part of other functional units.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A speaker arrangement comprising:

a first sound transducer for reproducing sound in a lower frequency range and having a first on-axis direction and a first centre point; and a second sound transducer for reproducing sound in a higher frequency range, the second sound transducer being mounted in front of the first transducer, the second sound transducer having a second on-axis direction and a second centre point;

wherein an angle between the first on-axis direction and the second on-axis direction is between 45° and 135° and a cross-over frequency between the lower frequency range and the higher frequency range is within the interval from 1.5 kHz to 3 kHz and a distance between the first centre point and the second centre point is not higher than a cross-over wavelength corresponding to the cross-over frequency, wherein a maximum dimension of an enclosure for the second sound transducer is less than a quarter of the cross-over wavelength.

2. The speaker arrangement of claim 1 wherein the first sound transducer is arranged in an upfiring configuration with the first on-axis direction having an angle relative to vertical of less than 50° with the speaker arrangement in an operational configuration.

3. The speaker arrangement of claim 1 wherein the second transducer is arranged in a front firing configuration with the second on-axis direction having an angle relative to horizontal of less than 50° with the speaker arrangement in an operational configuration.

4. The speaker arrangement of claim 1 wherein a volume of an enclosure for the second sound transducer is less than 4·d3 where d is a maximum dimension of a radiating surface of the second sound transducer.

5. The speaker arrangement of claim 1 wherein a volume of elements of a mounting arrangement for the second sound transducer within a space defined by a periphery of a radiating surface of the first sound transducer infinitely extended along the first on-axis direction is less than 6·d3 where d is a maximum dimension of a radiating surface of the second sound transducer.

6. The speaker arrangement of claim 1 further comprising:

a first enclosure (301) comprising only the first sound transducer;

a second enclosure (303) comprising only the second sound transducer; and a mounting structure (305) for positioning the first enclosure relative to the second enclosure.

7. The speaker arrangement of claim 1 wherein a volume of the mounting structure within a space defined by a periphery of a radiating surface of the first sound transducer infinitely extended along the first on-axis direction is less than 0.5·d3 where d is a maximum dimension of a radiating surface of the second sound transducer.

8. The speaker arrangement of claim 1 wherein a volume of elements of a mounting arrangement for the second sound transducer within a space defined by a periphery of a radiating surface of the first sound transducer infinitely extended along the first on-axis direction is less than 200 $cm^3$.

9. The speaker arrangement of claim 1 wherein a volume of the enclosure for the second sound transducer is less than 21 liters.

10. The speaker arrangement of claim 1 wherein an area of a radiating surface of the first sound transducer covered by a projection along the first on-axis direction of elements of a mounting arrangement for the second transducer is less than 50% of a total area of the radiating surface.

11. The speaker arrangement of claim 1 wherein the second centre point lies within a space defined by a periphery of a radiating surface of the first sound transducer infinitely extended along the first on-axis direction.

12. The speaker arrangement of claim 1 wherein a distance from a closest point of the second sound transducer to the first on-axis direction is less than a quarter of a maximum dimension of a radiating surface of the first sound transducer.

13. The speaker arrangement of claim 1 wherein the distance between the first centre point and the second centre point is higher than one tenth of the cross-over wavelength.

14. A method of providing a speaker arrangement, the method comprising:

providing a first sound transducer for reproducing sound in a lower frequency range and having a first on-axis direction and a first centre point; and providing a second sound transducer for reproducing sound in a higher frequency range, the second sound transducer being mounted in front of the first transducer, the second sound transducer having a second on-axis direction and a second centre point;

wherein an angle between the first on-axis direction and the second on-axis direction is between 45° and 135° and a cross-over frequency between the lower frequency range and the higher frequency range is within the interval from 1.5 kHz to 3 kHz and a distance between the first centre point and the second centre point is not higher than a cross-over wavelength corresponding to the cross-over frequency, wherein a maximum dimension of an enclosure for the second sound transducer is less than a quarter of the cross-over wavelength.

* * * * *

UNITED STATES PATENT AND TRADEMARK OFFICE

CERTIFICATE OF CORRECTION

PATENT NO. : 8,873,787 B2
APPLICATION NO. : 13/125138
DATED : October 28, 2014
INVENTOR(S) : Bergere et al.

It is certified that error appears in the above-identified patent and that said Letters Patent is hereby corrected as shown below:

On the title page item [73], delete "Konindlijke Philips N.V." and insert -- Koninklijke Philips N.V. --.

Signed and Sealed this
Third Day of February, 2015

Michelle K. Lee

Michelle K. Lee
*Deputy Director of the United States Patent and Trademark Office*